US006199860B1

(12) United States Patent
d'Agrella et al.

(10) Patent No.: US 6,199,860 B1
(45) **Date of Patent: *Mar. 13, 2001**

(54) MOTOR DRIVEN DELIVERY BUCKETS

(75) Inventors: Ingermar S. d'Agrella, Sussex; John M. Neary, Hartland; Nick R. Schetter, Rubicon; Dennis C. Sopik; Daniel L. Verhaagh, both of New Berlin, all of WI (US)

(73) Assignee: Quad/Tech, Inc., Sussex, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/222,408

(22) Filed: Dec. 29, 1998

(51) Int. Cl.[7] ..... B65H 29/20; B65H 29/00
(52) U.S. Cl. ..... 271/315; 271/314; 271/187
(58) Field of Search ..... 271/314, 315, 271/187; 270/6, 42, 43

(56) References Cited

U.S. PATENT DOCUMENTS 4,244,565 * 1/1981 Geier ..... 271/176
4,638,993 * 1/1987 Granzow et al. ..... 271/315
4,720,089 * 1/1988 Richter ..... 270/43
4,861,019 * 8/1989 Michalik ..... 271/315
4,881,731 * 11/1989 Simpson-Davis ..... 271/315
4,886,260 * 12/1989 Reist ..... 270/60
4,925,173 * 5/1990 Lindbolm et al. ..... 270/54
5,040,783 * 8/1991 Ruehl ..... 271/300
5,080,338 * 1/1992 Belanger et al. ..... 270/6
5,120,049 * 6/1992 Fischer ..... 271/315
5,123,638 * 6/1992 Mutou ..... 271/187
5,249,791 * 10/1993 Belanger et al. ..... 271/182
5,322,270 * 6/1994 Belanger et al. ..... 271/187
5,359,929 * 11/1994 Hansen ..... 101/232
5,405,126 * 4/1995 Mack ..... 270/6
5,653,428 * 8/1997 Dufour et al. ..... 270/6

* cited by examiner

*Primary Examiner*—Donald P. Walsh
*Assistant Examiner*—Daniel K Schlak
(74) *Attorney, Agent, or Firm*—Michael Best & Friedrich LLP

(57) ABSTRACT

A folder of a printing press wherein the bucket assemblies are mounted on shafts cantilevered from the folder frame, and wherein each shaft is rotatably driven and positionally controlled by a motor that is mechanically independent of the folder drive mechanism.

42 Claims, 1 Drawing Sheet

MOTOR DRIVEN DELIVERY BUCKETS

FIELD OF THE INVENTION

The present invention relates to a delivery section of a folder of a printing press. More particularly, the invention relates to a bucket assembly that is mounted for rotation on a cantilevered bucket shaft and relates to bucket assemblies that are each independently rotatably driven by a motor.

BACKGROUND OF THE INVENTION

In the printing industry, a desired image is repeatedly printed on a continuous web or substrate such as paper. In a typical printing process, the continuous web is slit in the longitudinal direction (the direction of web movement) to produce a plurality of continuous ribbons. The ribbons are aligned one on top of the other, folded longitudinally, and then cut laterally to produce a plurality of multi-page, approximately page-length segments, each of which is termed a "signature". The term signature also encompasses a single printed sheet that has or has not been folded. Because more than one different signature can be printed at one time, it is often desirable to separate the different signatures by transporting successive signatures in different directions or paths.

One way to accomplish the sorting of a single stream of signatures is to use a diverter mechanism such as a diverter wedge to divert successive signatures to one of two paths. Once diverted, the signatures typically are transferred to a conveyor using rotating buckets (also known in the art as fans, fan wheels, paddle fans, or rotary flywheels).

A typical configuration includes two sets of rotating buckets assemblies, one set to deliver signatures traveling along a first path to a conveyor and the other set to deliver signatures traveling along the second path to a conveyor. Each set of bucket assemblies includes several buckets arranged at a spaced distance from one another along a common axis or shaft. Each bucket has multiple aligned blades which define pockets or slots for receiving signatures and transferring the signature to the conveyor.

It is desirable to increase the operating speed of a printing press in order to increase the printed product output. However, as the rotational speed of the buckets is increased, it is more difficult to ensure the reliable operation of the buckets and ensure that the signatures are not damaged. For example, signature quality problems that can occur at higher press speeds include ink offset, dog-eared edges, and defects to both the leading and trailing edges of the signatures. These and other defects can lead to paper jams in the folder, resulting in press downtime and expense.

One type of prior art folder includes two sets of diverting areas therefore four bucket assemblies are needed to transfer the four different signatures types to four conveyors. The housing of such a folder typically includes only two bucket shafts on which are mounted the four bucket assemblies. Each shaft extends across the length of the folder housing and has two bucket assemblies thereon, one bucket assembly positioned on one end and the other bucket assembly positioned on the other end. One drive arrangement causes the rotation of both of the bucket assemblies on that respective shaft. The drive arrangement typically includes a series of shafts and pulleys driven by the folder drive mechanism, which includes a line shaft driven by the press motor. The drive arrangement drives the bucket shafts at the same operating speed as the other driven components of the folder. Therefore, individual control of the rotation of the bucket assemblies is not possible.

It is desirable to be able to individually control the rotation and the relative position of each bucket assembly in the folder to better control the rotational position of each bucket to match the timing at which the signatures enter the buckets of the bucket assemblies.

SUMMARY OF THE INVENTION

In the delivery section of a folder of a printing press, the invention includes a frame. A cantilevered bucket shaft is supported by the frame. A bucket assembly is supported by the shaft for rotation with the shaft. The invention further includes a motor operatively connected to each bucket shaft for rotatably driving the respective shaft independently of the folder line shaft and independently of the other bucket shafts.

It is a feature of the present invention to provide an improved bucket assembly mounting arrangement in the delivery section of a folder of a printing press.

It is another feature of the present invention to provide for individual control of the position of each bucket assembly as it rotates.

It is another feature of the present invention to rotatably position the bucket assemblies independent of the folder drive mechanism.

It is another feature of the present invention to rotatably drive bucket assemblies using a motor for each bucket assembly.

It is another feature of the present invention to mount bucket assemblies on bucket shafts cantilevered from the folder frame.

Other features and advantages of the invention will become apparent to those skilled in the art upon review of the following detailed description, drawings, and claims.

Figure 1:
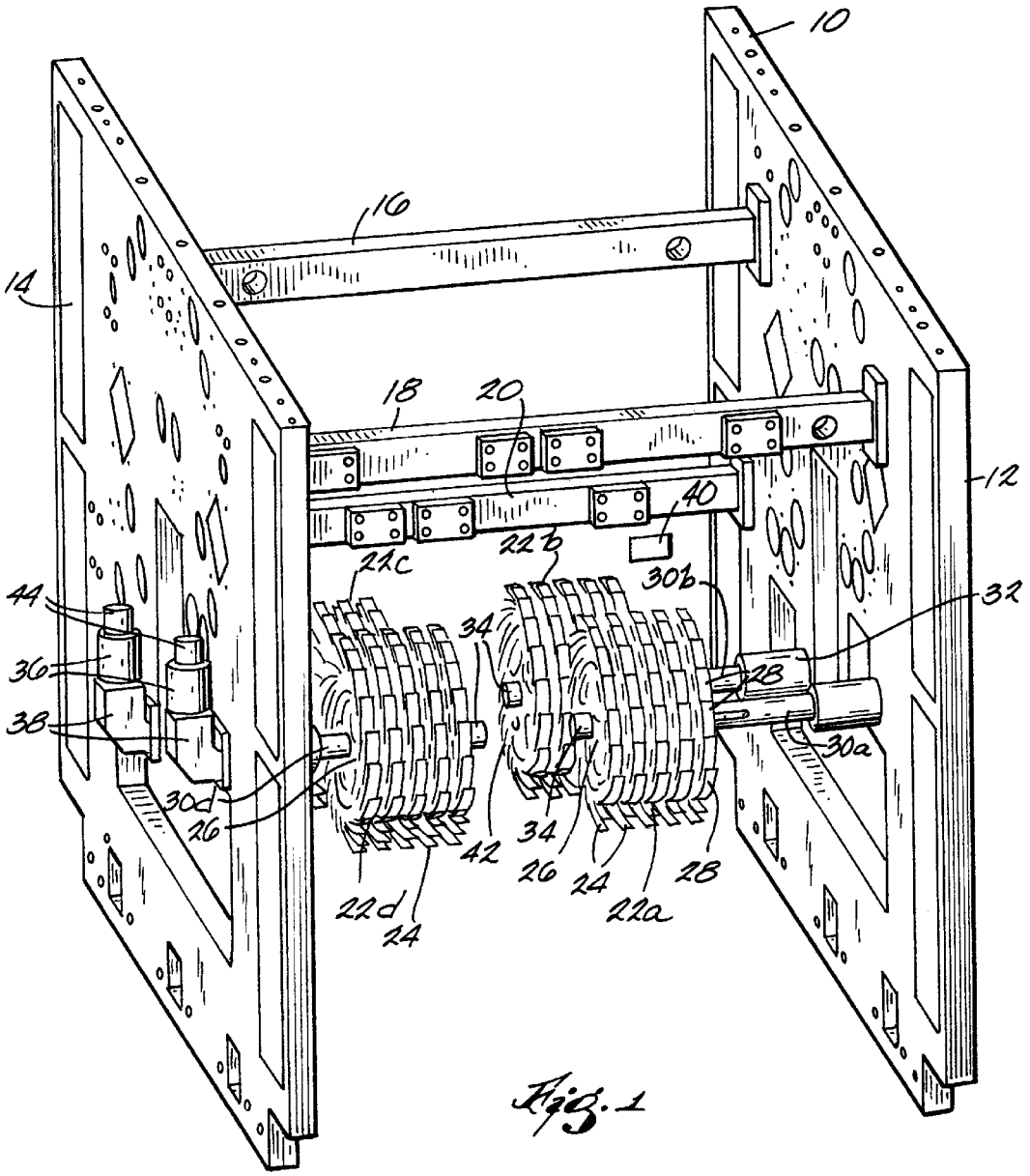
FIG. 1 is a perspective view of a delivery frame of a folder of a printing press embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

BRIEF DESCRIPTION OF THE PREFERRED EMBODIMENT

Illustrated in FIG. 1 is a housing of frame 10 of the delivery portion of a folder of a high speed printing press. An example of such a high speed printing press is the Harris M3000B web offset printing press. However, it should be noted that the present invention is applicable to other types and models of printing presses, such as sheet fed printing presses.

The frame 10 includes a pair of side frames or frame elements 12 and 14 joined by three rigid connector bars 16, 18 and 20 such that the frame elements 12 and 14 are rigidly joined and connected to one another in spaced apart generally parallel relationship. The frame 10 supports fans or bucket assemblies 22. In the illustrated embodiment, four bucket assemblies 22*a–d* are shown, two bucket assemblies 22*a* and 22*b* are supported by the frame element 12 and two bucket assemblies 22*c* and 22*d* are supported by the frame element 14. It should be noted that in other arrangements, more or fewer than the four bucket assemblies 22 can be supported by the frame 10.

The bucket assemblies 22*a–d* are positioned to receive signatures delivered to the bucket assemblies 22*a–d* from the press folder and to guide the signatures onto conveyor belts (not shown).

Each bucket assembly 22 includes a plurality of buckets 24. In the illustrated arrangement, each bucket assembly 22 is shown as including five buckets 24, however other numbers of buckets 24 can be employed with the present invention and the number of buckets 24 can varying among bucket assemblies 22. For example, in other arrangements, more or fewer than five buckets 24 can be provided in each bucket assembly 22.

Each bucket 24 includes a hub 26 with a plurality of curved blades 28 radiating from the hub 26 and forming a plurality of generally spiral pockets around the periphery of the hub. The pockets are intended to receive an individual signature fed into the bucket assembly 22. The buckets 24 are maintained in a desired position along their respective shafts 30, such as using a set screw. It should be noted that other means to position the buckets 24 on the shafts 30 can be employed. The shafts 30 may also include a key and the buckets 24 a keyway positionable in the key to prevent rotation of the buckets 24 about the respective shafts 30.

In the illustrated arrangement, the five buckets 24 are arranged so as to form a plurality of signature receiving pockets of the bucket assembly 22. Each of the bucket assemblies 22 is shown as including 20 pockets for receiving signatures, however, in other arrangements each bucket assembly 22 can be constructed to have more or fewer pockets.

Each bucket assembly 22*a–d* is supported for rotation on a bucket shaft 26*a–d*, respectively, cantilevered from the respective frame element 12 or 14. Each shaft 30 is journalled to the adjacent frame element 12 or 14 (shaft 30*c* hidden from view in FIG. 1) by a conventional bearing assembly 32 such that each shaft 30 is mounted and rotatable about its longitudinal axis. The pair of bucket assemblies 22*a* and 22*d* is supported on the pair of shafts 30*a* and 30*d* having a common longitudinal axis with the ends 34 of the shafts 30*a* and 30*d* being spaced apart. The pair of bucket assemblies 22*b* and 22*c* is supported on the pair of shafts 30*b* and 30*c*, respectively, having a common longitudinal axis with the ends 34 of the shafts being spaced apart.

Each shafts 30 is driven by a motor 36. Preferably, each shaft 30*a–d* is independently rotatably driven by a separate motor 36 (motors for shafts 30*a* and 30*b* hidden from view in FIG. 1). Preferably a servo motor is utilized such as, for example, model Beta2/3000 available from GE Fanuc. However, other types of motors such as, for example, AC motors, DC motors and stepper motors can also be utilized.

In the illustrated arrangement, each shaft 30 is preferably coupled to the motor 36 by a gear head 38. The gear head 38 preferably has a 20 to 1 gear ratio such that one rotation of the motor 36 will result in the movement of the respective bucket assembly 22 one position; i.e. one revolution of the motor equals one signature delivery. For example, a gear head 38 such as model RA90020 available from Bayside can be employed. The gear head 38 enables a smaller motor to be used. However, it should be noted that a gear head does not have to be employed with the present invention in that a larger motor without a gear head could also be used.

It will be appreciated that each of the bucket assemblies 22 are independently supported, are driven independent of the folder drive mechanism, and can be independently driven at speeds dependent upon the delivery of signatures to the individual bucket assemblies 22.

In the preferred form of the invention, an encoder (not shown) at the folder line shaft is in communication with and operably coupled to an encoder 44. Preferably, one encoder 44 is in communication with each motor 36. The line shaft encoder provides a signal to the encoders 44 at the motors 36 to drive the motors 36 in response to the operation of the folder. The position of each bucket assembly 22 can be independently controlled by the encoders such that movement and positions of the respective bucket assemblies 22 are optimized with respect to the folder operation.

In another embodiment of the invention, sensors 40 can be provided to sense the delivery of signatures. Signals from the sensors 40 are delivered to the motors 36 to control operation of the motors 36. For example, the sensors 40 can sense the leading edge of the signatures being delivered to the bucket assemblies 22. Signals from the sensors 40 can be provided to the motors 36 such that the bucket assemblies 22 are properly positioned to receive the signatures as the signatures are delivered to the bucket assembly 22.

The motors 36 and bucket assemblies 22 can also be phased so as to provide for optimum delivery of signatures to the bucket assemblies.

One of the features of the invention is the provision of bucket assemblies 22 which are independently mounted with respect to one another and such that there is a gap 42 or axis opening between two bucket assemblies 22 rotating about a common longitudinal axis. This gap 42 facilitates assembly or modification of the bucket assemblies 22. For example, the gap 42 permits removal of buckets 24 from the bucket assembly 22 without removal of the shafts 30 from the respective frame elements 12 or 14. Buckets 24 can be conveniently removed by axially sliding the buckets 24 off the end of the cantilevered shafts 30.

Various features and advantages of the present invention are set forth in the following claims.

We claim:

1. A delivery section in a folder of a printing press, the folder being driven by a folder drive mechanism, the delivery section comprising:

a frame;

a shaft cantilevered from and supported by the frame;

a bucket assembly supported by the shaft for rotation with the shaft; and a motor connected to the shaft for rotatably driving the shaft separately from the folder drive mechanism.

2. The delivery section of claim 1 and further including a control device operatively connected to the motor for controlling operation of the motor, the control device being responsive to the folder drive mechanism.

3. The delivery section of claim 2 wherein the control device is an encoder adapted to receive signals from the folder drive mechanism.

4. The delivery section of claim 1 wherein the motor includes a servo motor.

5. The delivery section of claim 1 wherein the frame includes a pair of spaced apart frame elements and wherein the shaft is supported by one of the frame elements.

6. The delivery section of claim 5 wherein the frame elements are connected by a plurality of connector bars such that the frame elements are oriented in a spaced apart parallel relationship.

7. The delivery section of claim 1 and further including a second shaft cantilevered from and supported by the frame and a second bucket assembly supported by the second shaft for rotation independent of the bucket assembly.

8. The delivery section of claim 7 and further including a second motor operatively connected to the second shaft for rotatably driving the second shaft.

9. The delivery section of claim 8 and further including a second control device operatively connected to the second motor for controlling operation of the second motor.

10. The delivery section for claim 7 wherein the first mentioned shaft and the second shaft have a common longitudinal axis of rotation.

11. The delivery section of claim 1 and further including a gear head operationally connected to the motor.

12. The delivery section of claim 1 and further including a sensor operationally connected to the motor for sensing movement of signatures traveling into the bucket assembly.

13. The delivery section of claim 1 wherein the bucket assembly includes at least one bucket.

14. The delivery section of claim 1 wherein the bucket assembly includes a plurality of buckets.

15. The delivery section of claim 14 wherein each of the plurality of buckets includes a hub and a plurality of blades extending radially therefrom.

16. A delivery section in a folder of a printing press, the folder including a folder drive mechanism, the delivery section comprising:

a frame;

a plurality of shafts supported by the frame;

a plurality of buckets, each of the buckets being supported by a separate one of the shafts for rotation with the respective shaft; and a plurality of motors supported by the frame, each individual motor being connected to one of the shafts for rotatably driving each of the shafts independently.

17. The delivery section of claim 16 and further including a control device operatively connected to each motor for controlling operation of the respective motor, the control devices being responsive to the folder drive mechanism.

18. The delivery section of claim 17 wherein the control devices are encoders adapted to receive signals from the folder drive mechanism.

19. The delivery section of claim 16 wherein the motors are servo motors.

20. The delivery section of claim 16 wherein the frame includes first and second spaced apart frame elements and wherein at least one of the shafts is supported by the first frame element and at least another of the shafts is supported by the second frame element.

21. The delivery section of claim 20 wherein the frame elements are connected by a plurality of connector bars such that the frame elements are oriented in a spaced apart parallel relationship.

22. The delivery section of claim 16 wherein two shafts have a first common longitudinal axis and another two shafts have a second common longitudinal axis.

23. A delivery section in a folder of a printing press comprising:

a frame including a pair of spaced apart exterior frame elements that define an interior and an exterior of the frame such that a web of printed material extends through the interior of the frame;

a cantilevered shaft supported by one of the exterior frame elements, the cantilevered shaft extending inwardly from the exterior of the frame into the interior of the frame; and a bucket assembly supported by the shaft for rotation with the shaft.

24. The delivery section of claim 23 and further including a motor connected to the shaft for rotatably driving the shaft.

25. The delivery section of claim 24 wherein the motor is a servo motor.

26. The delivery section of claim 23 and further including a second cantilevered shaft supported by the other of the exterior frame elements that does not support the first mentioned cantilevered shaft, and a second bucket assembly supported by the second shaft.

27. The delivery section of claim 26 and further including a second motor connected to the second shaft for rotatably driving the second shaft independently.

28. The delivery section of claim 26 wherein the first mentioned shaft and the second shaft have a common longitudinal axis of rotation.

29. The delivery section of claim 23 wherein the bucket assembly includes at least one bucket.

30. The delivery section of claim 29 wherein the at least one bucket includes a hub and a plurality of blades extending radially therefrom.

31. The delivery section of claim 23 wherein the bucket assembly includes a plurality of buckets.

32. The delivery section in a folder of a printing press, the folder including a drive, the delivery section comprising:

a frame having an interior and an exterior;

a shaft supported by the frame;

at least one bucket supported by the shaft; and a motor connected to the shaft for rotatably driving the shaft separately from the folder drive, the motor being positioned on the exterior of the frame.

33. The delivery section of claim 32 wherein the shaft is cantilevered from the frame.

34. The delivery section of claim 32 wherein the frame includes a pair of spaced apart generally parallel walls, wherein each of the walls is in communication with the interior and the exterior of the frame and the shaft is supported by one of the walls.

35. The delivery section of claim 32 and further including a second shaft supported by the other of the exterior frame elements which is not supporting the first mentioned shaft, a second bucket supported by the second shaft, and a second motor connected to the second shaft for rotatably driving the second shaft independent of the first mentioned shaft.

36. The delivery section of claim 35 wherein the first mentioned shaft and the second shaft are cantilevered from the frame.

37. The delivery section of claim 35 wherein the first mentioned shaft and the second shaft have a common longitudinal axis of rotation.

38. The delivery section of claim 32 wherein the motor is a servo motor.

39. The delivery section of claim 32 and further including a gear head operationally connected to the motor.

40. The delivery section of claim 32 and further including a sensor operationally connected to the motor for sensing movement of signatures traveling into the bucket.

41. The delivery section of claim 32 wherein the at least one bucket is a plurality of buckets.

42. A delivery section in a folder of a printing press comprising:

a frame including a first exterior frame element and a second exterior frame element;

a first cantilevered shaft supported by the first exterior frame element, the first cantilevered shaft extending inwardly from the first exterior frame element toward the second exterior frame element;

a second cantilevered shaft supported by the second exterior frame element, the second cantilevered shaft extending inwardly from second exterior frame element toward the first exterior frame element;

a first bucket assembly supported by the first cantilevered shaft for rotation with the first cantilevered shaft; and a second bucket assembly supported by the second cantilevered shaft for rotation with the second cantilevered shaft.

* * * * *